United States Patent [19]

Hermida

[11] Patent Number: 4,710,997

[45] Date of Patent: Dec. 8, 1987

[54] LAST-CASE FOR CLEANING FOOTWEAR

[76] Inventor: Felipe U. Hermida, Fuentemilanos 2 - hotel no. 3, Ciudad Puerta de Hierro, Madrid, Spain

[21] Appl. No.: 636,153

[22] Filed: Jul. 31, 1984

[30] Foreign Application Priority Data

Aug. 3, 1983 [ES] Spain ..... 273.882

[51] Int. Cl.[4] ..... A47L 23/18; A47L 23/28

[52] U.S. Cl. ..... 15/268

[58] Field of Search ..... 15/265, 266, 267, 268, 15/258; 12/123, 124, 136 R; 403/324, 361; 312/206, 229, 242, 245

[56] References Cited

U.S. PATENT DOCUMENTS

| | | | |
|---|---|---|---|
| 487,963 | 12/1892 | Pistorius | 15/265 |
| 632,776 | 9/1899 | Brooks | 15/265 X |
| 675,141 | 5/1901 | Scheunert | 403/324 |
| 747,640 | 12/1903 | Reinhold, Jr. | 15/265 |
| 850,458 | 4/1907 | Bagley | 15/265 X |
| 1,170,065 | 2/1916 | Hirschman | 15/265 |
| 1,320,392 | 11/1919 | Hirschman | 15/265 |
| 2,007,072 | 7/1935 | Buskey | 15/265 |
| 3,278,970 | 10/1966 | Bowles | 15/267 |
| 3,835,623 | 9/1974 | Kline | 403/360 X |
| 3,918,782 | 11/1975 | Allmand | 312/242 X |

FOREIGN PATENT DOCUMENTS

| | | | |
|---|---|---|---|
| 678501 | 3/1930 | France | 15/265 |
| 130932 | 2/1951 | Sweden | 15/265 |
| 1172282 | 11/1969 | United Kingdom | 15/267 |

*Primary Examiner*—Harvey C. Hornsby
*Assistant Examiner*—Scott J. Haugland
*Attorney, Agent, or Firm*—Ladas & Parry

[57] ABSTRACT

The present invention provides a last-case for use in cleaning footwear, the last-case comprising a wall cover adapted to be fixed to a wall, and an external cover removably connected to the lower edge of the wall cover, the external cover being movable between a closed and an open position. The wall cover is adapted to hold cleaning accessories and utensils, as well as a last. The last comprises an angular member having a pair of flaps at its one end, the flaps designed to be retained in corresponding flaps on the wall cover. The last further comprises a base piece connected to the angular member, as well as a heel piece which is attached to the end of the angular member remote from the flaps. The angular and base members are pivotally linked together by a pin. A segmented toothed wheel is located interjacent the angular and base members, and is also mounted about the pin. A releasable pawl is provided to engage the toothed wheel so that rotational movement of the base member in one direction relative to the angular piece is prevented.

15 Claims, 15 Drawing Figures

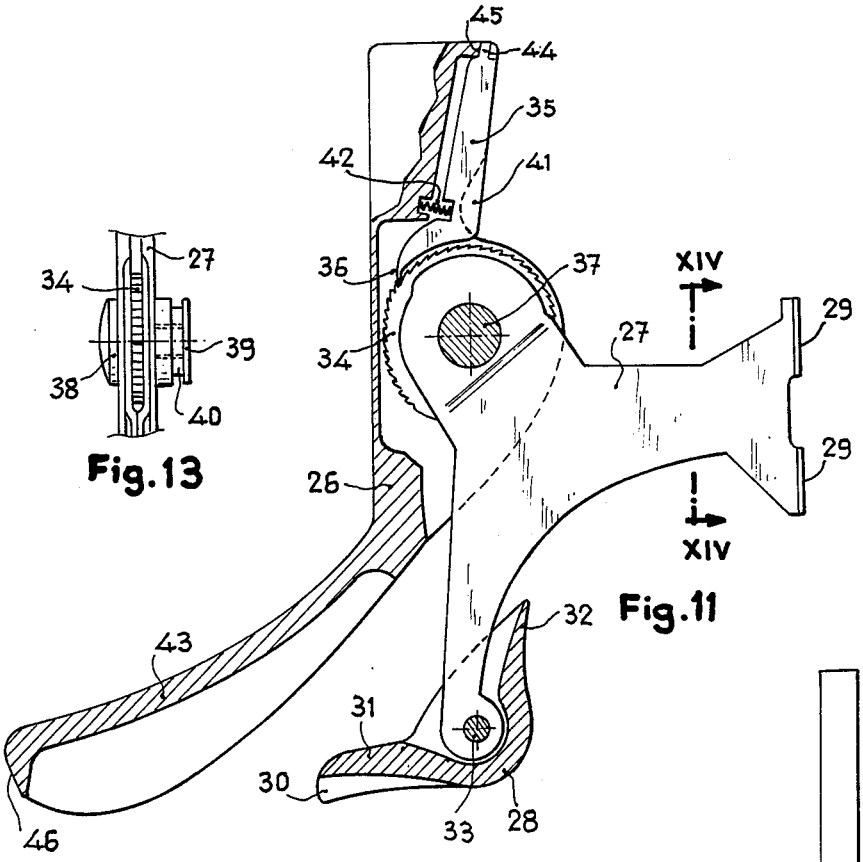
Fig.11
Fig.13
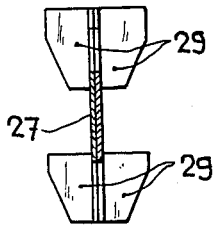
Fig.14
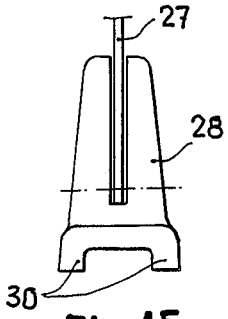
Fig.15
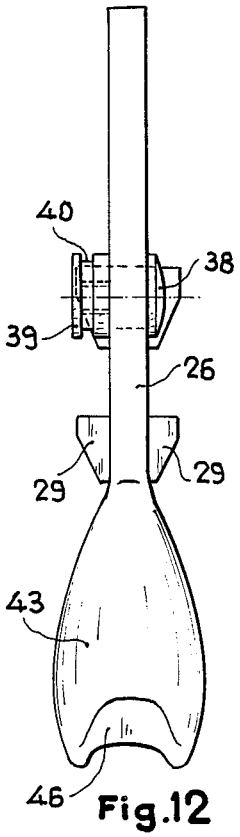
Fig.12

LAST-CASE FOR CLEANING FOOTWEAR

This invention relates to a last-case for cleaning footwear which constitutes a unified whole which may be folded and unfolded as the user wishes to place or set it in the state of rest (non-use) or state of utilization (work).

The last-case of the invention adopts a prismatic rectangular or quadrangular configuration of little depth, and preferably made of a metallic material, although it could very well be manufactured in wood or a special type of plastic and so forth.

In the above mentioned rectangular or quadrangular prismatic body three fundamental parts should be considered, independently from the last which will go inside and which may be set in the rest or work position within the prismatic body of the case.

The, three fundamental parts are :a back or wall cover designed to be fitted on a wall or any other flat vertical element; an external cover which tilts with regard to the said wall cover, which is able to occupy a closed position in a plane parallel to that defined by the wall cover, and which may tilt to occupy a horizontal position in front, in which case it constitutes a tray for the collection of the dirt from the shoes being cleaned. The third fundamental part of the body consists of a middle cover which tilts or swivels laterally with regard to the wall cover, this middle cover being designed to serve as a base and to secure the cleaning utensils proper, such as brushes, polishes, scrapers and so forth.

The set which as we have said is completed by the last which is secured to the wall cover, lying flat against this in the rest position and anchored perpendicularly, projecting frontwards, in the use or work position.

The body or case may be substituted by a single trapezoidal wall plate which will be secured to the wall, and which will have means for securing it, both in the rest and work position of the last, presenting the same characteristics as the above mentioned wall cover, but with slight differences, discussed hereunder.

According to the structural characteristics of the last-case being proposed and described, a highly practical tool is obtained for the purpose to which it is put, as it constitutes an object which takes up a minimum amount of space and may be affixed in any part of the dwelling (boxroom, terrace, kitchen, behind a door, etc.) so that the user will clean his footwear in a very comfortable, easy and simple manner, and without the slightest risk of getting dirty or having to accumulate and pile up in disorder to cleaning utensils, as they are perfectly placed and held inside the case.

In order to facilitate a better understanding of the characteristics of the invention, a detailed description will be made on the basis of the accompanying drawings.

Figure 4:
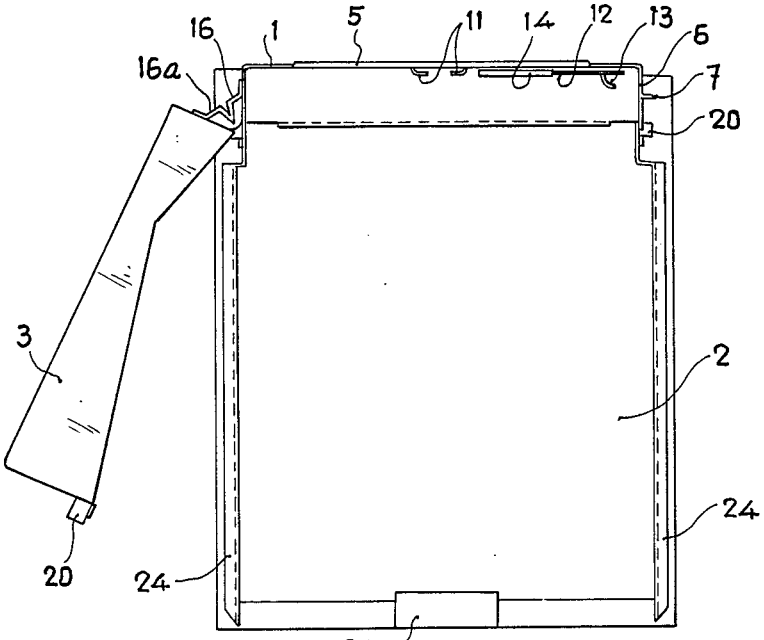

FIG. 4 shwos a plan view of the box-case itself with the middle cover open towards the corresponding side.

Figure 1:
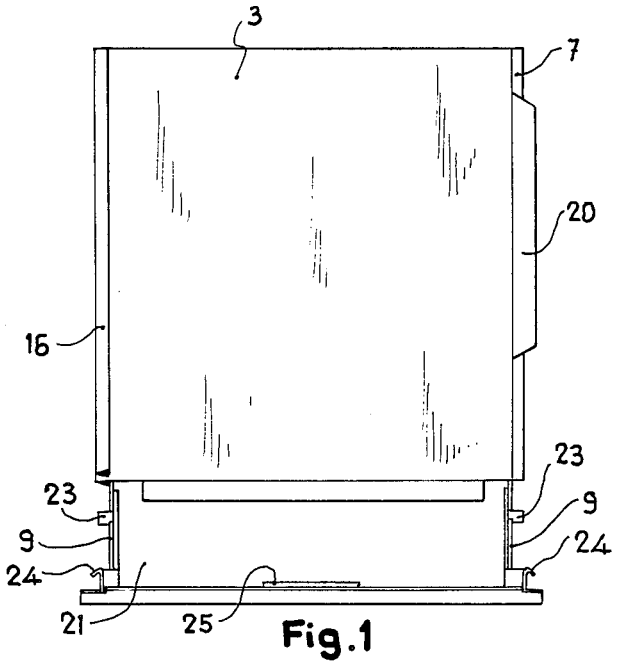
FIG. 1 shows a view of the box-case with the external cover open.
Figure 3:
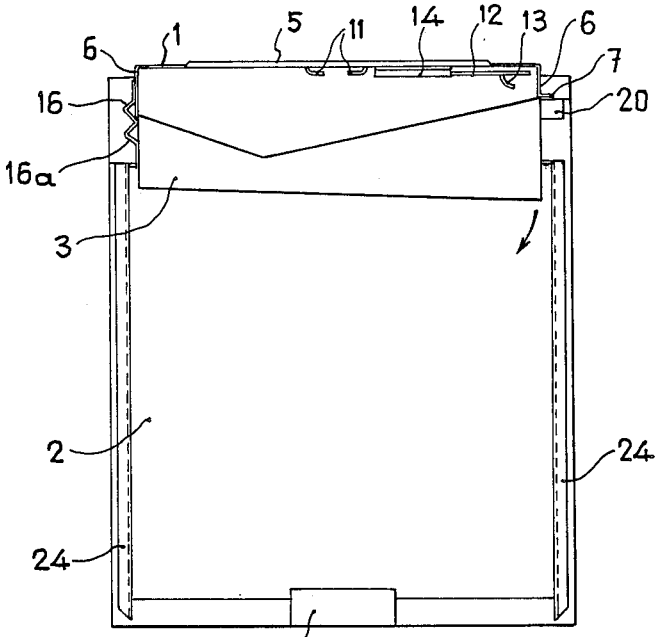
FIG. 3 shows a top plan view of the box-case, with the external cover open.
Figure 2:
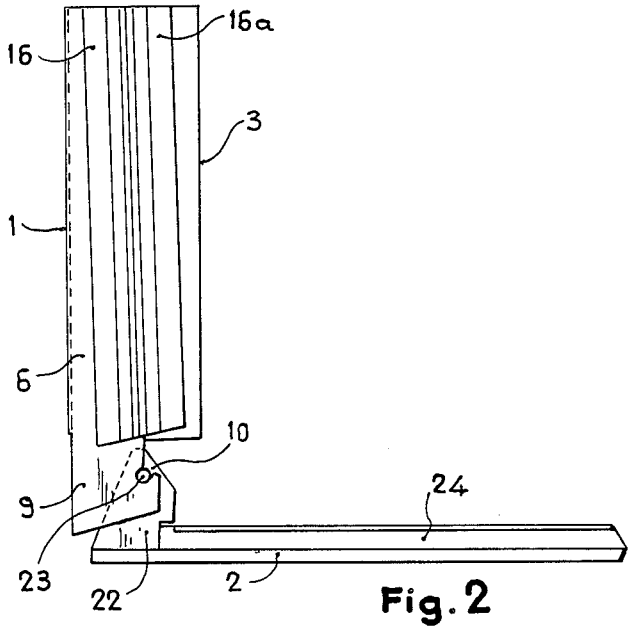
FIG. 2 shows a side view of the box-case shown in the previous figure.
Figure 5:
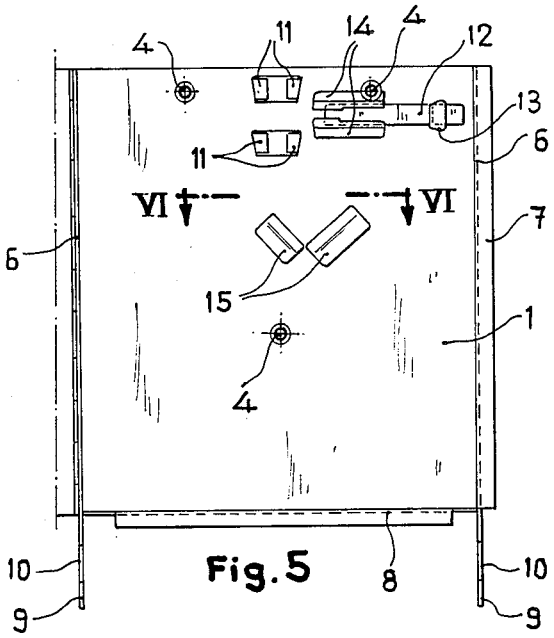

FIG. 5 shows a frontal view of the wall cover.

Figure 6:
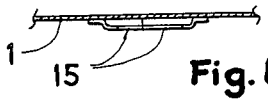

FIG. 6 shows a section along line VI—VI shown in FIG. 5.

Figure 7:
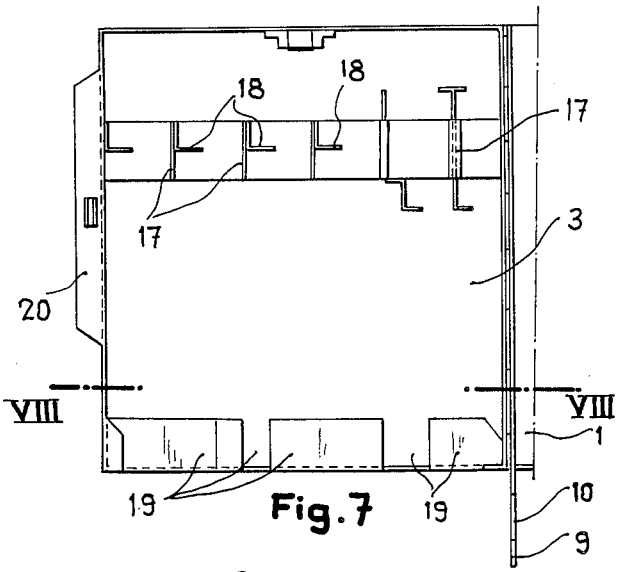

FIG. 7 shows a view of the inside face of the middle cover with the means of securing and base of the cleaning utensils.

Figure 8:
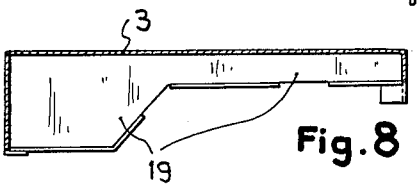

FIG. 8 shows a sectional view along the line VIII—VIII shown in the preceding figure.

Figure 9:
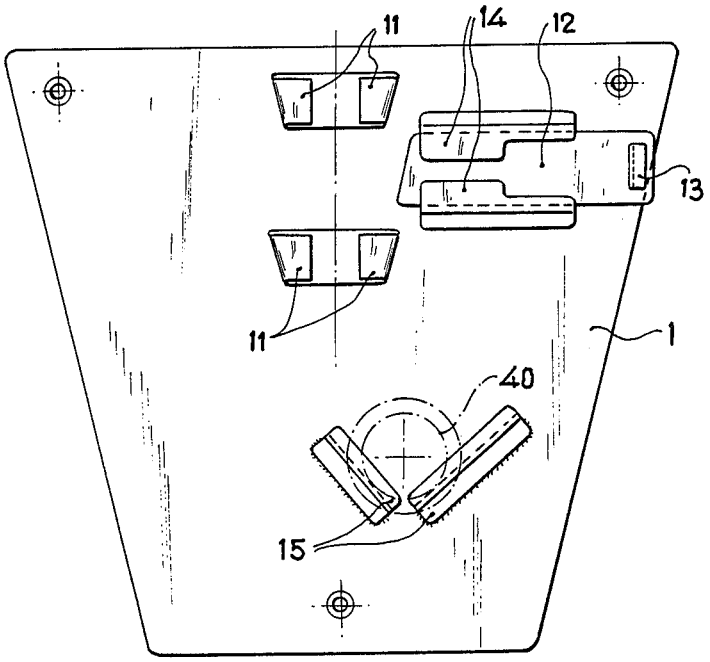

FIG. 9 shows a frontal view of a second embodiment of the wall cover which is trapezoidal in shape.

Figure 10:
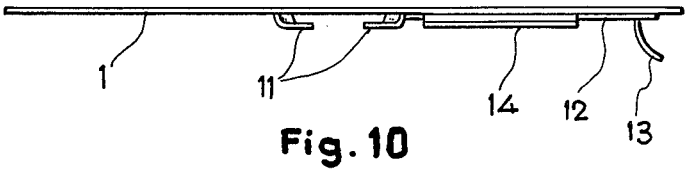

FIG. 10 shows a side view of the wall plate shown in FIG. 9.

FIG. 11 shows a longitudinal sectional view of the last which forms part of the box-case or set represented in the above figures.

FIG. 12 shows a frontal view of the last shown in FIG. 11.

FIG. 13 shows a detailed view of a portion of the last where the articulation of the two main parts can be seen.

FIG. 14 shows a sectional view along the line XIV—XIV shown in FIG. 11.

FIG. 15 shows a frontal view of the part constituting the heel piece of the last.

According to these figures, the last-case adopts in the non-use position a shallow rectangular prismatic configuration, and in this three fundamental parts determining the case proper are distinguished. These fundamental parts are: the wall cover (1), the external or closing cover (2) and the middle cover (3).

The wall cover (1), preferably formed by a metal plate, presents holes (4) for the insertion of corresponding screws affixing it to the wall. The said wall cover (1) presents, at its upper edge, a rib or external reinforcing edge (5), whereas its lateral edges extend in perpendicular lips (6), one of which elbows longitudinally and perpendicularly to define a narrow lip (7) which is on an anterior and frontal plane.

In turn, the front side of the said wall cover (1) presents in correspondence with its lower edge a horizontal lip (8), under which the side lips (6) extend into rims (9), one each, provided with hooking notches (10) for the placing and rotation of the tilting means of the front or external cover (2).

In the upper area and in the centre, the said wall cover (1) is provided with some cuts which originate rims (11) projected slightly outwards and placed in opposing pairs, with a small separation between each pair of rims (11) and the plane of the wall cover (1). Laterally to these pairs of rims (11) a bolt (12) has been placed, perfectly guided and sliding, the purpose of which will be commented upon later and which presents a protrusion (13) to prevent it from leaving the guide piece (14) on which it moves, interfering the area between the pairs of rims (11).

In the area below the rims (11), on the surface of the wall cover (1), two sections (15) are attached, placed at an angle to each other, and with their upper edges separated from the surface of the wall cover (1).

As for the middle cover (3), it is hinged laterally and vertically on the corresponding left lip (6) of the wall cover (1).

This middle cover (3) defines a type of small box open at the front, in its open position, to keep and contain the various utensils for cleaning footware. The middle cover (3) and wall cover (1) are hingedly connected to each other by a pair of rectangular plates 16 and 16*a*, the plates having a flexible groove therebetween. The plate 16 is fixed to the lip (6) on the wall cover (1) while the plate 16*a* is fixed to the edge of the middle cover (3). To prevent the middle cover (3) from folding or closing involuntarily from the open position, the hinge is inclined or obliquely mounted with respect to the wall and middle covers. Also, the grooves between the plates (16 and 16a) are constructed or configured so as to prevent the middle cover 3 from banging against the wall on which the wall cover is mounted when the middle cover is opened.

The angular deformations or limits of maximum opening of the middle cover (3) house inside elongated "blocks" of transverse section in "X" of a suitable plastic material, which are the pieces commented upon earlier and which determine the hinge pro per linking or tying the wall cover (1) and the middle cover (3). This middle cover (3) has on its internal surface suitable pieces and plates (17) with upturned rims (18) for the securing and base of the brushes and cleaning cloths, whereas in a lower area there is defined a shelf or small balcony (19) for the polishes and other utensils, these elements may be fixed mobile and/or movable (see FIG. 7).

On the side edge opposite that of the hinge, the middle cover (3) has an extension (20) which comes up against the lip (7) of the wall cover (1), both having complementary devices (magnets, for example) for closing.

For its part, the front or external cover (2) has an internal box (21) as a limit, box (21) having sides (22) whose lateral edges abut horizontal lip (8) as shown in FIG. 5. Box (21) is also used for the collection of the dirt resulting from cleaning, and this box will be on the inside face and at the bottom when in the closed position. The sides (22) of the box (21) present emerging pivots (23) which are placed in the hooking notches (10) of the rims (9) of the wall cover (1), determining the means of rotation and tilting between 0° and 90° of the said external cover (2). This external cover (3) is formed by a panel or plate, preferably of wood, fitted on a frame consisting of sections (24), the upper edge of which has a magnetic plate (25) complementing another magnetic piece provided for this purpose on the wall cover (1) or middle cover (3), in order to effect closing. This cover is outstanding and may be fully moved.

The case thus defined is attached to the wall by screws passing through the wall cover (1) in the rest position being fully closed and taking up a minimum of volume, so that when it is desired to use it, it will suffice to open the external cover (2), it remaining in the horizontal position forming a tray. Then the middle cover will be opened laterally, all the utensils and accessories being at hand and perfectly visible and ordered so that the user may take the one he wishes or which he is going to use.

This case is complemented by the last on which the shoe will be placed in order to clean it.

Before describing the last, we should indicate that FIGS. 9 and 10 show views of a variant of the trapezoidal wall cover, constituting in the case a wall plate the particular features and characteristics of which are similar to those described, presenting the rims (11), the bolt (12), with its limit (13) although in this case with a different configuration, and also the sections (15). Although in this case the general characteristics are maintained, we may say that the bolt (12) is of smaller dimensions and that the limit (13) has a different configuration.

Turning to the description of the last now, it is constituted by the functional association of three pieces, with other complementary pieces, the three pieces are: a base piece (26), a fixed and angular piece (27), articulated to the above and a piece called the "heel piece" (28) articulated to the fixed and angular piece (27).

The above mentioned fixed angular piece (27) is flat, and has at one end two pairs of flaps (29), perpendicular to the plane of the piece (27) and lateral to it, the flaps (29) of which are destined to be housed and retained, in the working position, between the rims (11) of the wall cover (1) and its surface or end, as is natural the said flaps (29) being positioned vertically and anchored and immobilized by the passage of the bolt (12) which will come between the pairs of rims (11) of the wall cover (1).

The bottom of the angular piece (27) presents the articulated heel piece (28) which is provided with a hole (not piercing) for the securing of any type and variety of footwear, also presenting side projections (30) coincing with the external line (31) of the piece, and more pronounced towards the end.

The opposite end (32) presents a smooth shape for greater functionality.

The said heel piece (28) is articulated according to the axis (33) to the said angular piece (27) the end of the latter being housed in a groove provided for this purpose in the heel piece (28), as seen in FIGS. 11 and 15.

On the vertex of the angular piece (27) a widened area is defined and provided with a flat recess or opening in which a toothed wheel (34) is located The recess is defined by a pair of sidewalls constituting the vertex of the angular piece (best seen in FIGS. 11 and 13). The recess has an inclined base, indicated by line 70 in FIG. 11. The wheel is segmented in the recess so that the flat edge abuts the base of the recess. The wheel will thus not be capable of rotating about its axis when mounted in the recess. a piece (35) finished in the form of a pawl (36) acts on the wheel allowing the base piece (26) to rotate in one direction and prevents it from rotating in the other, unless pressure is applied on the piece (35) of the pawl (36) releasing the toothed wheel (34) from this, in which case the said base piece can rotate in both directions.

The above mentioned angular piece (27), by its widened area where the toothed wheel (34) is located, is housed in another flat recess provided for this purpose in the base piece (26), this presenting an opening in correspondence with its back edge to allow and define the recess housing the toothed wheel (34) located in turn in the said area of the angular piece (27).

The articulation between both pieces (26) and (27) is made by means of a pin (37) with a head (38) on one of the ends, and a nut (39) at the other, made in suitable plastic, the nut of which is cylindrical and defines annularly a throat (40) by which the last is placed in the rest position, lying flat on its side against the wall cover (1), by virture of which in the said throat (40) the emerging edges of the pieces (15) are housed, fixed on the wall cover (1).

The said base piece (26), at its top end bears the piece (35) of the pawl (36), being provided with several lateral notches (41) to make it possible to apply pressure to the said piece (35), this being moved outwards, and with this towards the working position of the pawl (36) by means of a expansion spring (42) duly housed in an internal recess of the base piece (26) which at its opposite end presents a hollow extrusion (43), the configuration of which defines a last for placing the footwear to be cleaned on, with its front edge or end in a smoothed shape (46).

One may also say that the top end of the piece (35) presents a small protrusion (44) which is housed in an orifice (45) of the top edge of the base piece (26), so that the above mentioned piece (35) may be perfectly anchored.

Thus the last in the working position, as we have said, is secured vertically and at the front by the rims (11) provided in the wall cover, so that the base piece (26) may be adjusted as wished to position the footwear as desired, by virture of the rotation of the piece with regard to the angular fixed piece (27), in addition positioning the heel of the shoe on the heel piece (28).

What is claimed is:

1. A last-case for use in cleaning footwear, the last-case comprising:

a wall cover adapted to be mounted in a substantially vertical position, the wall cover comprising a pair of projecting sections, the sections each being placed at an angle to the other;

an external cover detachably fixed to the lower edge of the wall cover and pivotable thereon between a closed position wherein the external cover and wall cover are substantially parallel, and an open position wherein the external cover is approximately at right angles to the wall cover; and a last adapted for mounting in the last case, the last comprising:

an angular member having at least one end, the at least one end of the angular member being releasably fixed to the wall cover by a pair of interconnecting flaps, the angular member comprising a widened area defining a flat opening, the flat opening providing a housing;

a base member pivotally connected to the angular member between its ends;

a heel member connected to the at least one end of the angular member remote from the flaps;

a segmented, toothed wheel interjacent the angular member and the base member, the toothed wheel being fixed relative to the angular member and abutting the housing provided by the flat opening to prevent its rotation, the base member being rotable relative to the toothed wheel and including a housing, the housing being mounted over the widened area of the angular member and the toothed wheel;

a pawl member on the base member, one end of which is adapted to engage the toothed wheel to lock the base member in a plurality of positions relative to the angular member, the pawl being releasable from the toothed wheel to permit rotation of the base member in both directions;

a pin, the pin lying in an axis normal to the toothed wheel so that the base ember is pivotable about the pin relative to the angular member, the angular member, toothed wheel, and base member all being mounted about the pin, the pin comprising a head at one end and a threaded portion at another end;

a locknut having an annular channel, the locknut being received by the threaded portion of the pin for securing the pin in position and being held by the engagement of the projecting sections of the wall cover which are received in the annular channel.

2. A last-case as claimed in claim 1 further comprising an expansion spring between a pawl and the base member, the spring normally urging the end of the pawl into engagement with the toothed wheel.

3. A last-case as claimed in claim 2 wherein the spring is located in a recess in the base member.

4. A last-case as claimed in claim 2 wherein the pawl comprises at least one notch to facilitate the application of manual force to the pawl against the action of the spring to disengage the pawl from the toothed wheel.

5. A last-case as claimed in claim 1 wherein the heel member is pivotally connected to the angular member between its ends, said heel member having at least one end, the one end of the heel piece incorporating a pair of downward side projections.

6. A last-case as claimed in claim 1 wherein the wall cover comprises a pair of flaps located approximately centrally thereof, the flaps being adapted to releasably receive corresponding flaps on the angular member of the last by sliding the angular member downwardly into the flaps in a plane parallel to the wall cover to secure the last in a working position, the last being retained in position on the flaps by a sliding bolt mounted on the wall cover, the bolt being adapted to slide between each of the pair of corresponding flaps on the angular member so as to secure the angular member to the wall cover.

7. A last-case as claimed in claim 6 wherein the bolt further comprises an annular projection thereabout and abutment means adjacent the bolt to limit the extent of the axial movement of the bolt on the wall cover.

8. A last-case as claimed in claim 1 wherein the upper edge of the wall cover comprises an external reinforcement border, the side edges of the wall cover comprise perpendicular lips, the lips extending below the lower edge of the wall cover to provide projecting rims, the rims being provided with notches, the external cover being secured to the notches.

9. A last-case as claimed in claim 8 wherein the external member comprises a sheet of wood of slight thickness, the sheet of wood being fixed to a frame, and wherein a small box is provided thereon for the collection of dirt.

10. A last-case as claimed in claim 9 wherein the box includes a pair of projecting pivots, the pivots being adapted to be received in the notches of the rims on the wall member.

11. A last-case as claimed in claim 1 further comprising a middle member, the middle member being hingedly connected to the wall cover by a hinge extending down the side edges of the middle member and wall member.

12. A last-case as claimed in claim 11 wherein the middle member is adapted to receive and hold cleaning utensils and accessories.

13. A last-case as claimed in claim 11 wherein the hinge between the middle member and wall member is located obliquely relative to the side edges of the middle member and wall member to prevent involuntary closure of the middle member from the open position.

14. A last-case as claimed in claim 13 wherein the hinge connecting the middle member and wall member includes at least one groove and a corresponding projection extending longitudinally down the hinge, the groove and projection preventing the middle member from rotating about the hinge beyond a predetermined angular position.

15. A last-case as claimed in claim 11 wherein the middle member includes one or more ledges and plates for holding cleaning brushes, cloths and the like.

* * * * *